US012789959B2

(12) United States Patent
Gurr

(10) Patent No.: US 12,789,959 B2
(45) Date of Patent: Nov. 10, 2026

(54) BREATHING APPARATUS, CONTROLLER FOR A BREATHING APPARATUS AND METHOD OF OPERATING A BREATHING APPARATUS

(71) Applicant: AVON POLYMER PRODUCTS LIMITED, Wiltshire (GB)

(72) Inventor: Kevin Peter Gurr, Dorset (GB)

(73) Assignee: AVON POLYMER PRODUCTS LIMITED, Wiltshire (GB)

( * ) Notice: Subject to any disclaimer, the term of this patent is extended or adjusted under 35 U.S.C. 154(b) by 713 days.

(21) Appl. No.: 18/259,412

(22) PCT Filed: Dec. 30, 2021

(86) PCT No.: PCT/EP2021/087870
§ 371 (c)(1),
(2) Date: Jun. 27, 2023

(87) PCT Pub. No.: WO2022/148705
PCT Pub. Date: Jul. 14, 2022

(65) Prior Publication Data

US 2024/0253757 A1 Aug. 1, 2024

(30) Foreign Application Priority Data

Jan. 5, 2021 (GB) ..... 2100101

(51) Int. Cl.
*B63C 11/24* (2006.01)
*B63C 11/02* (2006.01)

(52) U.S. Cl.
CPC ..... *B63C 11/24* (2013.01); *B63C 2011/021* (2013.01)

(58) Field of Classification Search
CPC ..... B63C 2011/021
See application file for complete search history.

(56) References Cited

U.S. PATENT DOCUMENTS 4,753,117 A 6/1988 Osterhout et al.
4,939,647 A 7/1990 Clough et al.
(Continued)

FOREIGN PATENT DOCUMENTS

DE 102013020098 B3 3/2015
EP 0324259 A2 7/1989
(Continued)

OTHER PUBLICATIONS

International Search Report for PCT Application No. PCT/EP2021/087870 dated Apr. 21, 2022 (14 pages).
(Continued)

*Primary Examiner* — Brandy S Lee
*Assistant Examiner* — Mishal Zahra Hussain
(74) *Attorney, Agent, or Firm* — Calfee, Halter & Griswold LLP

(57) ABSTRACT

The present invention provides a breathing apparatus and a controller for a breathing apparatus. The controller is configured to receive a first output signal from a pressure sensor in the breathing apparatus, wherein the first output signal is indicative of variations in a total gas pressure within the breathing apparatus. The controller is further configured to determine, using the first output signal, an oxygen consumption rate of a user of the breathing apparatus. This may enable the controller to determine the user's oxygen consumption rate, without having to rely on an oxygen sensor. The breathing apparatus may be a rebreather, which is used for underwater diving.

19 Claims, 3 Drawing Sheets

(56) References Cited

U.S. PATENT DOCUMENTS

| | | | | |
|---|---|---|---|---|
| 5,617,848 | A | 4/1997 | Cochran | |
| 6,003,513 | A | 12/1999 | Readey et al. | |
| 2017/0100610 | A1* | 4/2017 | Gurr | A62B 9/006 |
| 2017/0283020 | A1* | 10/2017 | Gurr | A61M 16/1005 |
| 2018/0001980 | A1 | 1/2018 | Hulbert | |
| 2020/0001956 | A1* | 1/2020 | Gauthier | B63C 11/16 |
| 2020/0094929 | A1* | 3/2020 | Raymaekers | B63C 11/24 |

FOREIGN PATENT DOCUMENTS

| | | | |
|---|---|---|---|
| EP | 0919462 | A2 | 6/1999 |
| EP | 1145740 | A1 | 10/2001 |
| EP | 3626595 | A1 | 3/2020 |
| GB | 2525973 | B | 7/2016 |
| WO | 2015145106 | A2 | 10/2015 |
| WO | 2017212464 | A1 | 12/2017 |

OTHER PUBLICATIONS

Search Report for correponding GB Application No. GB2100101.1 dated Jun. 21, 2021 (6 pages).

* cited by examiner

BREATHING APPARATUS, CONTROLLER FOR A BREATHING APPARATUS AND METHOD OF OPERATING A BREATHING APPARATUS

CROSS-REFERENCE TO RELATED APPLICATIONS

This application is a U.S. National Stage Application under 35 U.S.C. § 371 of International Patent Application No. PCT/EP2021/087870, filed Dec. 30, 2021, which claims priority to Great Britain Patent Application No. 2100101.1 filed Jan. 5, 2021, each of which are hereby incorporated by reference as if set forth in their respective entireties herein.

FIELD OF THE INVENTION

The present invention relates to a controller for a breathing apparatus, a breathing apparatus, and a method of operating the breathing apparatus.

BACKGROUND OF THE INVENTION

A rebreather is a type of breathing apparatus that is used for underwater diving. In a rebreather, used gas exhaled by a user of the breathing apparatus is recirculated and reused, to permit the rebreathing (i.e. recycling) of the unused oxygen content of the used gas. Used gas has a lower oxygen content than unused gas, because some of the oxygen in the unused gas is used (metabolised) by the user of the breathing apparatus. Oxygen is therefore normally added to the used gas to replace the oxygen used by the user of the breathing apparatus.

It is important to control the oxygen content of the gas in the rebreather. In particular, it is important to control the concentration (or the proportion) of oxygen in the gas in the rebreather, which is normally expressed by the partial pressure of oxygen in the gas in the rebreather. The partial pressure of oxygen ($PPO_2$) in a gas mixture is given by:

$$PP\,O_2 = P \times FO_2 \tag{1}$$

where P is the total pressure of the gas mixture and $FO_2$ is the volume fraction of oxygen in the gas mixture.

If the partial pressure of oxygen in the gas in the rebreather falls below a minimum safe partial pressure (which may depend on e.g. the user's physiology and level of exertion and on the exposure time), the user of the breathing apparatus may be at risk of unconsciousness or death due to hypoxia. On the other hand, if the partial pressure of oxygen in the gas in the rebreather rises above a maximum safe partial pressure (which may also depend on e.g. the user's physiology and level of exertion and on the exposure time), the user of the breathing apparatus may be at risk of oxygen toxicity, which may result in seizures and even death in severe cases.

Therefore, it is important to control the partial pressure of oxygen in the gas in the rebreather, so that the partial pressure of oxygen remains within safe limits. In known rebreathers, this is achieved by providing the rebreather with a plurality of oxygen sensors (typically electro-galvanic oxygen sensors) for sensing the partial pressure of oxygen in the gas in the rebreather, and a control system for controlling the partial pressure of oxygen in the gas in the rebreather (e.g. to be equal to a target partial pressure of oxygen, which may be referred to as the target set-point of the rebreather) based on the output of one or more of the plurality of oxygen sensors.

However, as discussed in the inventor's earlier patent (GB2525973B, which is incorporated herein by reference), the sensitivity and accuracy of the oxygen sensors may decay over time, which may affect the control system's ability to accurately control the partial pressure of oxygen. To counter this effect, it is known to use electronic "voting logic" systems, where predetermined criteria are used to determine which oxygen sensor outputs should be used when determining the $PPO_2$ in the gas in the rebreather, and which (if any) should be disregarded.

SUMMARY OF THE INVENTION

At its most general, the present invention provides a controller for a breathing apparatus, which is configured to determine an oxygen consumption rate of a user of the breathing apparatus, based on an output signal received from a pressure sensor in the breathing apparatus. In this manner, the controller may determine the user's oxygen consumption rate, without having to rely on an oxygen sensor in the breathing apparatus. In particular, the pressure in the breathing apparatus may vary as a user of the apparatus breathes, such that the user's breathing pattern and hence oxygen consumption rate can be determined from the output signal from the pressure sensor. The user's oxygen consumption rate can then be used, for example, to estimate the $PPO_2$ in the breathing apparatus, to ensure that the $PPO_2$ remains at a safe level. Additionally, the user's oxygen consumption rate can be used as an input in a control algorithm for controlling the partial pressure of oxygen.

Thus, monitoring and controlling of the $PPO_2$ in the breathing apparatus may be performed using the output signal from the pressure sensor, even in cases where no oxygen sensors are available, or where the oxygen sensors are not working properly. Moreover, it is possible to combine the determined oxygen consumption rate with readings from oxygen sensors in the breathing apparatus, which may improve an accuracy with which $PPO_2$ can be monitored and controlled, as well as provide a level of redundancy. Using the output signal from the pressure sensor to determine the oxygen consumption rate may avoid issues associated with the decaying accuracy and sensitivity of oxygen sensors over time, thus improving a reliability and safety of the breathing apparatus. In particular, as the pressure sensor in the breathing apparatus does not need to be sensitive to a specific component of the gas in the breathing apparatus, the pressure sensor may not suffer from the reliability issues associated with the oxygen sensors, and so may provide an accurate output over a longer lifetime.

According to a first aspect of the invention, there is provided a controller for a breathing apparatus, the controller being configured to: receive a first output signal from a pressure sensor in the breathing apparatus, wherein the first output signal is indicative of variations in a total gas pressure within the breathing apparatus; and determine, using the first output signal, an oxygen consumption rate of a user of the breathing apparatus.

The controller may be configured to be communicatively coupled to the pressure sensor, in order to receive the first output signal from the pressure sensor. For example, the controller may be connectable to the pressure sensor via a wired or wireless connection.

The controller may be implemented using any suitable computing or processing device. The controller may comprise a memory having computer-executable instructions stored therein, and a processor configured to execute the computer executable instructions, such that execution of the computer-executable instructions causes the controller to perform the described steps.

The pressure sensor may be any suitable sensor for detecting variations (i.e. changes) in total gas pressure within the breathing apparatus. Thus, the pressure sensor detects variations in the total pressure of a gas mixture present in the breathing apparatus, and need not be sensitive to partial pressures of individual components of the gas mixture in the breathing apparatus. In particular, the pressure sensor is not an oxygen sensor that detects a partial pressure of oxygen.

Herein, a total gas pressure in the breathing apparatus may refer to a pressure of a gas mixture that is present in the breathing apparatus. In contrast, a partial pressure may correspond to an individual component (such as oxygen or carbon dioxide) of the gas mixture in the breathing apparatus.

The pressure sensor may be in a breathing loop of the breathing apparatus, such that the pressure sensor is configured to detect variations in a total gas pressure of a gas mixture present in the breathing loop. Thus, the first output signal may be indicative of variations in the total gas pressure in the breathing loop of the breathing apparatus. For example, the breathing apparatus may be a rebreather, comprising a breathing loop and a mouthpiece for breathing gas in the breathing loop. A pressurised oxygen supply tank may be connected to the breathing loop via a supply valve.

As an example, the pressure sensor may be a differential pressure sensor. Such a differential pressure sensor may detect variations in the total gas pressure within the breathing apparatus relative to a reference pressure. For instance, the reference pressure may correspond to a pressure outside the breathing apparatus. The differential pressure sensor may comprise a first pressure sensor which is located inside the breathing apparatus, and which is linked to an ambient pressure sensor located outside the breathing apparatus, so that a pressure variation resulting from breathing of the user can be calculated.

The pressure sensor is configured to produce a first output signal that is indicative of variations in the total gas pressure in the breathing apparatus. In other words, the first output signal may vary in accordance with the pressure variations in the breathing apparatus. Thus, a period and amplitude of the first output signal may be related to a period and amplitude of the pressure variations in the breathing apparatus. For example, the pressure sensor may comprise a transducer for converting variations in the total gas pressure in the breathing apparatus into an electrical signal.

The oxygen consumption rate of the user can be determined using the first output signal in a variety of different ways. The oxygen consumption rate may correspond to a rate at which oxygen is used (i.e. metabolised) by the user, and may be expressed, for example, in litres per minute.

The first output signal may be representative of the user's breathing pattern, such that the controller can determine the user's oxygen consumption rate from the first output signal. In particular, a waveform of the first output signal may be representative of the user's breathing pattern. During use of the breathing apparatus, the total gas pressure in the breathing apparatus will vary over time as the user inhales and exhales. These variations in the pressure are reflected in the first output signal, which may vary over time in accordance with the user's breathing pattern. For example, the first output signal may comprise a series of peaks and troughs, corresponding to peaks and dips in the total gas pressure in the breathing apparatus, which may be caused by the user exhaling and inhaling, respectively. So, for example, the controller may analyse the first output signal, in order to determine a breathing pattern of the user.

The user's breathing pattern may be indicative of their oxygen consumption rate. For instance, rapid and/or deep breathing may be indicative of a high oxygen consumption rate, whilst slow and/or shallow breathing may be indicative of a low oxygen consumption rate. The controller may thus be configured to determine the oxygen consumption rate based on the determined breathing pattern. Additionally, the user's breathing pattern can be used as an indication of carbon dioxide retention.

The controller may be configured to record the determined oxygen consumption rate over time. In this manner, the controller may learn a range of typical oxygen consumption rates, which may be used as an input for controlling the breathing apparatus.

The controller may be configured to store a relationship between a breathing rate of the user and oxygen consumption of the user, and determining the oxygen consumption rate may comprise: determining a breathing rate of the user from the first output signal; and determining, based on the breathing rate, the oxygen consumption rate using the relationship. Thus, by determining the breathing rate from the first output signal, the controller can determine the corresponding oxygen consumption rate from the stored relationship.

As an example, in order to determine the breathing rate, the controller may record a sample of the first output signal for a period of time, and analyse the recorded sample of the first output signal to determine the number of breaths in the recorded sample (e.g. by counting a number of peaks in the recorded sample), and thus the user's breathing rate.

The relationship between the breathing rate of the user and the oxygen rate of the user may be stored in a memory of the controller. The relationship may be determined prior to use of the breathing apparatus, and then stored in the memory of the controller. In some cases, the relationship may be based on a theoretical model for oxygen metabolism. Alternatively, the relationship may be determined experimentally, by performing suitable measurements. For example, a breathing machine can be used to measure a user's oxygen consumption rate as a function of their breathing rate. Various known types of breathing machine may be used for this purpose. As an example, the breathing machine may include a closed circuit rebreather with an electronic controller, which may be used at depth in a stable recompression chamber.

The relationship may take into account factors such as the user's tidal volume, which may vary as a function of their breathing rate. In this manner the accuracy with which the oxygen consumption rate is determined may be improved. The tidal volume refers to a lung volume of the user, and corresponds to a volume of air displaced when the user inhales. The user's tidal volume may vary, depending on the user's breathing rate.

For example, the determined breathing rate may be used to calculate the user's tidal volume based on a relationship between the user's breathing rate and tidal volume. As oxygen consumption rate (metabolism) is a function of tidal volume and breathing rate, the user's oxygen consumption rate can then be determined.

The relationship stored by the controller may be specific to a particular user, such that the controller is calibrated for that user. For example, the relationship may have been determined based on breathing measurements that were performed with that user. As a result, the controller may be able to determine the user's oxygen consumption rate with high accuracy.

In some cases, the controller may be configured to store a plurality of user profiles, each profile being associated with a respective relationship between breathing rate and oxygen consumption rate for the user. The controller may then have a user interface to enable a user to select one of the plurality of user profiles. The controller may then be configured to determine the oxygen consumption rate using the relationship associated with the selected user profile. This may enable the controller to accurately determine the oxygen consumption rate for different users. For example, the relationship between breathing rate and oxygen consumption rate may be experimentally determined for multiple different users, and then stored in the controller. Alternatively, the different user profiles may be pre-set profiles corresponding to different user characteristics (e.g. user age, height, mass, etc.).

The controller may be configured to control a partial pressure of oxygen in the breathing apparatus, based on the determined oxygen consumption rate. In other words, the controller may use the determined oxygen consumption rate of the user as an input in a control algorithm for controlling the $PPO_2$ in the breathing apparatus. In this manner, the controller may respond in real-time to the user's oxygen needs, to ensure that an appropriate $PPO_2$ is maintained in the breathing apparatus. The controller may be configured to maintain the $PPO_2$ in the breathing apparatus at a set-point value.

The $PPO_2$ in the breathing apparatus may be controlled in various ways. In some cases, the controller may be configured to control an injection rate of oxygen into the breathing apparatus, based on the determined oxygen consumption rate. In this manner, the amount of oxygen injected into the breathing apparatus may depend on the user's oxygen consumption rate. For example, the controller may set the oxygen injection rate to match (i.e. compensate for) the user's oxygen consumption rate, such that the $PPO_2$ in the breathing apparatus is maintained at a substantially constant value. Thus, if the user's oxygen consumption rate increases, the controller may increase an amount of oxygen injected into the breathing apparatus. Conversely, if the user's oxygen consumption rate decreases, the controller may decrease an amount of oxygen injected into the breathing apparatus. The controller may control the injection rate of oxygen into the breathing apparatus by controlling an injection valve (e.g. by controlling a position or duty cycle of the injection valve). Oxygen may be injected into the breathing apparatus from an oxygen supply tank, via the injection valve.

Additionally or alternatively, the controller may be configured to control venting of gas from the breathing apparatus, in order to control the $PPO_2$ in the breathing apparatus. For example, the controller may be configured to control a venting valve of the breathing apparatus.

The controller may be further configured to: receive a second output signal from an oxygen sensor, wherein the second output signal is indicative of a partial pressure of oxygen in the breathing apparatus; and determine a current value of the partial pressure of oxygen in the breathing apparatus, using the second output signal. Thus, the controller may obtain a direct reading of $PPO_2$ in the breathing apparatus via the oxygen sensor. This may facilitate control of the $PPO_2$ in the breathing apparatus. Moreover, by monitoring the $PPO_2$ in the breathing apparatus, the controller can confirm accuracy of the oxygen consumption rate that is determined from the first output signal.

In some cases, the controller may be configured to control the $PPO_2$ in the breathing apparatus, based on the determined $PPO_2$ in the breathing apparatus. In particular, the controller may be configured to maintain the $PPO_2$ in the breathing apparatus at a set-point value, e.g. by controlling the injection rate of oxygen into the breathing apparatus and/or venting of gas from the breathing apparatus.

The controller may be further configured to: if the current value of the partial pressure of oxygen is within a predetermined range around a set-point of the controller, control the partial pressure of oxygen in the breathing apparatus based on the determined oxygen consumption rate; and if the current value of the partial pressure of oxygen is outside the predetermined range around the set-point of the controller, control the partial pressure of oxygen in the breathing apparatus based on the current value of the partial pressure of oxygen. In other words, control of the $PPO_2$ in the breathing apparatus is performed based one the oxygen consumption rate or the current value of the $PPO_2$, depending on how close the current value of $PPO_2$ is to the set-point.

Thus, when the current value of $PPO_2$ is close to the set-point (i.e. within the predetermined range around the set-point), the determined oxygen consumption rate may be used for controlling the $PPO_2$ in the breathing apparatus. This may provide more accurate control of the $PPO_2$ around the set-point, as the controller can accurately compensate for oxygen consumed by the user by injecting a corresponding amount of oxygen into the breathing apparatus. Thus, when the current value of the $PPO_2$ in the breathing apparatus is within the predetermined range around the set-point, the oxygen injection rate may be determined using the oxygen consumption rate (e.g. the oxygen injection rate may be set to the oxygen consumption rate).

When the current value of $PPO_2$ is further away from the set-point (i.e. when it is outside the predetermined range), the current value of $PPO_2$ may be used for controlling the $PPO_2$ in the breathing apparatus. This may provide less accurate control than using the oxygen consumption rate, however it may enable the $PPO_2$ to rapidly be brought close to the set-point. This may also serve to ensure that the $PPO_2$ does not drift away from the set-point over time, or overshoot the set-point due to over-injection of oxygen, which might occur if only the oxygen consumption rate were used for controlling $PPO_2$. As an example, when the $PPO_2$ is outside the predetermined range, the controller may be configured to control the injection rate of oxygen into the breathing apparatus to be proportional to a difference between the current value of $PPO_2$ and the set-point.

Changing the manner in which the $PPO_2$ in the breathing apparatus is controlled depending on whether the current value of $PPO_2$ is within the predetermined range or not may improve accuracy of $PPO_2$ control around the set-point. The predetermined range around the set-point may be a narrow range around the set-point. For example, the predetermined range may correspond to a range of +/−0.025 bar around the set-point.

The controller may be further configured to, in response to detecting a failure of the oxygen sensor, control the partial pressure of oxygen in the breathing apparatus based on the determined oxygen consumption rate. Thus, in a situation where the oxygen sensor is no longer working properly, the oxygen consumption rate can be used for controlling the $PPO_2$ in the breathing apparatus. As discussed above, an injection rate of oxygen into the breathing apparatus, and/or a venting rate of gas out of the breathing apparatus, can be controlled by the controller in order to control $PPO_2$ in the breathing apparatus. Accordingly, a safety of the breathing apparatus may be improved, as the $PPO_2$ in the breathing apparatus may still be reliably controlled, even in a situation where the oxygen sensor is not working.

A failure of the oxygen sensor may be detected in various ways. For example, a failure may be detected if the output signal from the oxygen sensor is out of normal bounds, e.g. if it is outside a predetermined range. Various processing techniques may also be applied to the output signal of the oxygen sensor in order to detect a failure. In some cases, the breathing apparatus may include multiple oxygen sensors, in which case the output signal of the oxygen sensor can be compared with output signals from the other oxygen sensors, to determine if it is working properly. A truth (comparison) table may be used to compare the oxygen sensors and determine which of the oxygen sensors to rely on. Another possibility for detecting a failure of the oxygen sensor is to perform a sensitivity test with the oxygen sensor. Such a sensitivity test may, for example, comprise raising and/or lowering the $PPO_2$ set-point, and checking if the output signal of the oxygen sensor responds accordingly.

The controller may be configured to, in response to detecting a failure of the oxygen sensor, determine an estimate of the partial pressure of oxygen in the breathing apparatus using the determined oxygen consumption rate and a previously determined value of the partial pressure of oxygen. In this manner, the controller can still monitor the $PPO_2$ in the breathing apparatus, even when the oxygen sensor is not working. This may enable the controller to ensure that the $PPO_2$ is kept at a safe level in the breathing apparatus. The previously determined value of the $PPO_2$ may be a value of the $PPO_2$ that was determined by the controller at a time when the oxygen sensor was still working correctly. Starting from this previously determined value of the $PPO_2$, the controller can estimate the current value of the $PPO_2$ by calculating an amount of oxygen consumed by the user since the time when that value was determined (e.g. by integrating the determined oxygen consumption rate over time). The estimate can also take into account an amount of oxygen injected into breathing apparatus during this time.

The controller may be configured to further receive an output signal from a depth sensor of the breathing apparatus, which is indicative of an underwater depth of the breathing apparatus. Using the output signal from the depth sensor, the controller can determine the underwater depth of the breathing apparatus, which the controller can then use to estimate the partial pressure of oxygen in the breathing apparatus. In particular, as the partial pressure of oxygen in the breathing apparatus may vary as a function of underwater depth of the breathing apparatus, the controller can take into account the depth of the breathing apparatus when estimating the partial pressure of oxygen in the breathing apparatus. This may serve to provide an accurate estimate of the partial pressure of oxygen, e.g. if the oxygen sensor is not working properly. This may facilitate estimating the partial pressure of oxygen when the user is ascending or descending (i.e. when their underwater depth is increasing or decreasing). Thus, in the case mentioned above where there is a failure of the oxygen sensor, the controller may be configured to determine an estimate of the partial pressure of oxygen in the breathing apparatus using the determined oxygen consumption rate, a previously determined value of the partial pressure of oxygen, and the determined depth of the breathing apparatus.

The controller may be further configured to monitor a breathing pattern of the user using the first output signal from the pressure sensor, and, in response to detecting an anomaly in the breathing pattern, generate an alert. An anomalous breathing pattern of the user may be indicative of one or more conditions that may be dangerous and therefore should be alerted to the user. In particular, an anomalous breathing pattern may result from a change of gas flow in the breathing apparatus, and/or of a restriction in the breathing apparatus which may prevent the user from breathing properly. An anomaly in the breathing rate may also be indicative of hypercapnia, hypoxia, and/or a high work of breathing.

Herein, a breathing pattern may refer to one or more characteristics of the user's breathing. For example, the breathing pattern may correspond to a breathing rate, and/or an amplitude of pressure variations in the breathing apparatus caused by the user's breathing. As discussed above, both the amplitude of pressure variations in the breathing apparatus, as well as the user's breathing rate can be determined from the first output signal from the pressure sensor.

An anomaly in the user's breathing pattern may be detected based on a sudden change in the user's breathing pattern, e.g. a sudden change in breathing rate and/or amplitude of the pressure variations in the breathing apparatus. Additionally or alternatively, the controller may store parameters (e.g. breathing rate and/or amplitude of pressure variations) corresponding to a "normal" breathing pattern. The controller may then compare the user's breathing pattern with the stored parameters and, if the user's breathing pattern differs from the stored parameters by more than a threshold amount, the controller may determine an anomaly in the breathing pattern.

The controller may be configured to generate the alert in any suitable manner. For example, the controller comprise (or be connected to) a display which is configured to display the alert. Additionally or alternatively, the controller may comprise (or be connected to) a speaker configured to generate an audible alert.

In response to detecting the anomaly in the breathing pattern, the controller may be configured to determine that a valve in the breathing apparatus has failed. The controller may then alert the user that the valve has failed and is no longer working properly. For example, the controller may determine that a valve in a mouthpiece of the breathing apparatus has failed. The breathing pattern of the user may change in a predictable manner when the valve fails, such that the controller can determine failure of the valve when such a change in the breather pattern is observed. For instance, a failure of the valve may be associated with a reduction in the amplitude of pressure variations in the breathing apparatus that are caused by the user's breathing. The controller may be programmed with one or more criteria which, when detected in the breathing pattern, cause the controller to determine that the valve has failed. The specific criteria that are used by the controller will depend on the nature of the valve in question, as well as the position of the pressure sensor relative to the valve. The criteria used by the controller for determining failure of the valve can be determined experimentally, and then programmed in to the controller. The valve may, for example, correspond to a directional (e.g. a one-way) valve located in a mouthpiece of the breathing apparatus.

Additionally or alternatively, in response to detecting the anomaly in the breathing pattern, the controller may be configured to determine that the user is at increased risk of carbon dioxide retention. Carbon dioxide retention of the user may occur, for example, as a result of increased density (or partial pressure) of the gas in the breathing apparatus, and/or due to increased exertion of the user. The controller may be programmed with one or more criteria which, when detected in the breathing pattern, cause the controller to determine that the user is at increased risk of carbon dioxide retention. Typically, increased carbon dioxide retention may result in a modified breathing pattern, such as an increased breathing rate. Shallow breathing (e.g. where the tidal volume is low) may also be an indication of carbon dioxide retention. So, if the controller detects an increase in breathing rate that exceeds a stored criterion, and/or a tidal volume that is below a stored criterion, the controller may determine that the user is at increased risk of carbon dioxide retention. The criterial used by the controller for determining that the user is at increased risk of carbon dioxide retention can be determined experimentally, and then programmed in to the controller.

The controller may be further configured to: receive a third output signal from a high pressure sensor of the breathing apparatus, wherein the third output signal is indicative of a pressure in an oxygen supply tank of the breathing apparatus; and determine an amount of oxygen consumed by the user based on the third output signal. Thus, the third output signal from the high pressure sensor may provide a further means for determining oxygen consumption by the user. This may enable the controller to cross-check the oxygen consumption rate determined using the first output signal. The pressure in the oxygen supply tank is related to the amount of oxygen stored in the supply tank. As oxygen is used (i.e. as it is injected into the breathing apparatus from the supply tank), the pressure in the supply tank will drop by a corresponding amount. So, by monitoring the pressure in the supply tank, it is possible to determine how much oxygen the user has consumed. Injection of oxygen from the supply tank may be controlled primarily as a function of oxygen consumption.

The high pressure sensor may also be used as a back-up for estimating oxygen consumption and/or controlling the oxygen injection rate, e.g. in case of failure of the pressure sensor and/or the oxygen sensor. For example, the controller may record the third output signal from the high pressure sensor, and the determined oxygen consumption rate over time. This may enable the controller to determine a historical trend of the oxygen consumption rate, and/or a relationship between the oxygen consumption rate and the third output signal. Then, if the pressure sensor fails, the controller may estimate the current oxygen consumption rate based on the historical trend and the relationship between the oxygen consumption rate and the third output signal.

The controller may be further configured to determine a carbon dioxide production rate of the user, using the determined oxygen consumption rate. Carbon dioxide production by the user is directly related to the amount oxygen consumed by the user, such that the controller can calculate the carbon dioxide production rate from the determined oxygen consumption rate. Indeed, the user's carbon dioxide production rate is typically proportional to their oxygen consumption rate. For example 1.78 litres of oxygen consumed by the user may produce approximately 1.6 litres of carbon dioxide (i.e. approximately 0.9 litres of carbon dioxide may be produced per litre of oxygen consumed).

The controller may be configured to determine a remaining lifetime of a carbon dioxide absorbent unit in the breathing apparatus, based on the determined carbon dioxide production rate. The remaining lifetime of the carbon dioxide absorbent unit may refer to an amount of remaining time before the carbon dioxide unit becomes saturated, based on the user's current carbon dioxide production rate. The carbon dioxide absorbent unit may have a known carbon dioxide absorption capacity, which is used by the controller for determining the remaining lifetime. As the determination of the remaining lifetime of the carbon dioxide absorbent unit is based on the user's current metabolism (i.e. their oxygen consumption and carbon dioxide production rates), it is possible to accurately predict how much longer the carbon dioxide absorbent unit will last. This may serve to ensure that the breathing apparatus is not used after the carbon dioxide absorbent unit has become saturated.

Typically, a breathing apparatus that is used for underwater diving may comprise a carbon dioxide absorbent unit (often referred to as a "scrubber"), which absorbs carbon dioxide exhaled by the user, in order to avoid build-up of carbon dioxide in the breathing apparatus. As the carbon dioxide absorbent unit absorbs carbon dioxide, it gradually becomes saturated until it no longer absorbs any more carbon dioxide. Once the carbon dioxide absorbent unit becomes fully saturated, carbon dioxide content of the gas mixture in the breathing apparatus may increase, which may be dangerous for the user.

Usage of the carbon dioxide absorbent unit may depend on the partial pressure (or density) of carbon dioxide in the breathing apparatus, and so may depend one or more variables such as underwater depth, the gas mixture in the breathing apparatus, a work rate of the user, and a temperature of the gas in the breathing apparatus. Accordingly, the controller may take these variables into account when estimating the remaining lifetime of the carbon dioxide absorbent unit. In some embodiments, a lookup table may be stored in the controller, which links values of the one or more variables to a usage rate of the carbon dioxide absorbent unit. The lookup table may be established experimentally, prior to use of the breathing apparatus. Then, the controller may determine current values of the one or more variables (e.g. based on outputs from relevant sensors in the breathing apparatus), and determine a corresponding usage rate of the carbon dioxide absorbent unit using the lookup table. From the determined usage rate, a remaining lifetime of the carbon dioxide absorbent unit may be estimated. This may be used to validate or improve the estimate obtained from the oxygen consumption rate.

The controller may be configured to notify the user of the remaining lifetime of the carbon dioxide absorbent unit. For example, the controller may be configured to display the remaining lifetime of the carbon dioxide absorbent unit on a display. This may enable the user to ensure that the breathing apparatus is still safe to use.

The controller may be further configured to: receive a fourth output signal from a carbon dioxide sensor in the breathing apparatus, wherein the fourth output signal is indicative of a partial pressure of carbon dioxide in the breathing apparatus; and determine a current value of the partial pressure of carbon dioxide ($PPCO_2$) in the breathing apparatus, using the fourth output signal. Thus, the carbon dioxide sensor may provide a direct reading of the $PPCO_2$ in the breathing apparatus. This may enable the controller to ensure that the $PPCO_2$ is maintained at a safe level in the breathing apparatus, and that the apparatus is functioning properly. The $PPCO_2$ in the breathing apparatus is given by:

$$PP\,CO_2 = P \times F\,CO_2 \tag{2}$$

where P is the total pressure of the gas mixture in the breathing apparatus, and $FCO_2$ is the volume fraction of carbon dioxide in the gas mixture.

The controller may be further configured to monitor the partial pressure of carbon dioxide in the breathing apparatus, and to determine, based on the partial pressure of carbon dioxide, one or more of the following conditions: a failure with a valve in the breathing apparatus; saturation and/or bypassing of a carbon dioxide absorbent unit in the breathing apparatus; and an increased risk of carbon dioxide retention by the user. The controller may be programmed with one or more criteria for detecting any of these conditions.

As an example, a failure with a valve in the breathing apparatus may result in some of the gas exhaled by the user not passing through the carbon dioxide absorbent unit. As a result, $PPCO_2$ in the breathing apparatus may gradually increase. The controller may therefore determine that a valve in the breathing apparatus has failed, based on an increase of the $PPCO_2$ in the breathing apparatus.

The controller may determine saturation and/or bypassing of the carbon dioxide absorbent unit based on an increase in the $PPCO_2$ in the breathing apparatus.

The controller may also determine that the user is at an increased risk of carbon dioxide retention based on an increase in $PPCO_2$ in the breathing apparatus.

The specific criteria used by the controller for determining the above conditions will depend on the location of the carbon dioxide sensor in the breathing apparatus, as well as the layout of the breathing apparatus (e.g. the locations of the valves and carbon dioxide absorbent unit). Accordingly, the criteria used by the controller can be determined experimentally.

The controller of the first aspect of the invention may for part of a breathing apparatus. Therefore, according to a second aspect of the invention, there is provided a breathing apparatus comprising: a pressure sensor configured to detect variations in total gas pressure within the breathing apparatus, and to produce a first output signal indicative of the variations in total gas pressure within the breathing apparatus; and a controller according to the first aspect of the invention. Any of the features discussed above in relation to the first aspect of the invention may be shared with the breathing apparatus of the second aspect of the invention.

In some embodiments, the breathing apparatus may be a rebreather apparatus. The breathing apparatus may be designed for underwater use, i.e. so that it may be used for underwater diving.

The breathing apparatus may further comprise one or more of: an oxygen sensor configured to detect a partial pressure of oxygen in the breathing apparatus, and to produce a second output signal indicative of the partial pressure of oxygen in the breathing apparatus; an oxygen supply tank, and a high pressure sensor configured to detect a pressure in the oxygen supply tank and to produce a third output signal indicative of the pressure in the oxygen supply tank; a carbon dioxide sensor configured to detect a partial pressure of carbon dioxide in the breathing apparatus, and to produce a fourth output signal indicative of the partial pressure of carbon dioxide in the breathing apparatus; and a carbon dioxide absorbent unit configured to absorb carbon dioxide present inside the breathing apparatus.

The breather apparatus may further include other types of sensor, such as a temperature sensor for detecting a temperature of the gas in the breathing apparatus, and/or a depth sensor for determining an underwater depth of the breathing apparatus.

According to a third aspect of the invention, there is provided a method of operating a breathing apparatus, the method comprising: receiving a first output signal from a pressure sensor in the breathing apparatus, wherein the first output signal is indicative of variations in total gas pressure within the breathing apparatus; and determining, using the first output signal, an oxygen consumption rate of a user of the breathing apparatus.

The method of the third aspect may be performed using the breathing apparatus of the second aspect of the invention, and/or the controller of the first aspect of the invention. Therefore, any features discussed above in relation to the first or second aspects of the invention may be shared with the method of the third aspect of the invention.

The method may further comprise storing a relationship between a breathing rate of the user and oxygen consumption of the user, and determining the oxygen consumption rate may comprise determining a breathing rate of the user from the first output signal; and determining, based on the breathing rate, the oxygen consumption rate using the relationship.

Prior to storing the relationship, the method may comprise determining the relationship. This may be performed experimentally, for example by performing breathing measurements on the user.

The method may comprise controlling a partial pressure of oxygen in the breathing apparatus, based on the determined oxygen consumption rate. This may include, for example, controlling an injection rate of oxygen into the breathing apparatus, and/or a venting rate of gas from the breathing apparatus.

The method may comprise: receiving a second output signal from an oxygen sensor, wherein the second output signal is indicative of a partial pressure of oxygen in the breathing apparatus; and determining a current value of the partial pressure of oxygen in the breathing apparatus, using the second output signal.

The method may further comprise: if the current value of the partial pressure of oxygen is within a predetermined range around a set-point of the controller, controlling the partial pressure of oxygen in the breathing apparatus based on the determined oxygen consumption rate; and if the current value of the partial pressure of oxygen is outside the predetermined range around the set-point of the controller, controlling the partial pressure of oxygen in the breathing apparatus based on the current value of the partial pressure of oxygen.

The method may comprise, in response to detecting a failure of the oxygen sensor, controlling the partial pressure of oxygen in the breathing apparatus based on the determined oxygen consumption rate.

The method may comprise, in response to detecting a failure of the oxygen sensor, determining an estimate of the partial pressure of oxygen in the breathing apparatus using the determined oxygen consumption rate and a previously determined value of the partial pressure of oxygen.

The method may comprise monitoring a breathing pattern of the user using the first output signal from the pressure sensor, and, in response to detecting an anomaly in the breathing pattern, generating an alert.

The method may comprise, in response to detecting the anomaly in the breathing pattern, determining that a valve in the breathing apparatus has failed, and/or that the user is at increased risk of carbon dioxide retention.

The method may comprise receiving a third output signal from a high pressure sensor of the breathing apparatus, wherein the third output signal is indicative of a pressure in an oxygen supply tank of the breathing apparatus; and determining an amount of oxygen consumed by the user based on the third output signal.

The method may comprise determining a carbon dioxide production rate of the user, using the determined oxygen consumption rate.

The method may further comprise determining a remaining lifetime of a carbon dioxide absorbent unit in the breathing apparatus, based on the determined carbon dioxide production rate.

The method may comprise monitoring the partial pressure of carbon dioxide in the breathing apparatus, and determining, based on the partial pressure of carbon dioxide, one or more of the following: a failure with a valve in the breathing apparatus (e.g. a valve in a mouthpiece of the breathing apparatus); saturation and/or bypassing of a carbon dioxide absorbent unit in the breathing apparatus; and an increased risk of carbon dioxide retention by the user.

BRIEF DESCRIPTION OF THE DRAWINGS

Embodiments of the invention will now be described by way of example with reference to the accompanying drawings, in which.

DETAILED DESCRIPTION; FURTHER OPTIONS AND PREFERENCES

Figure 1:
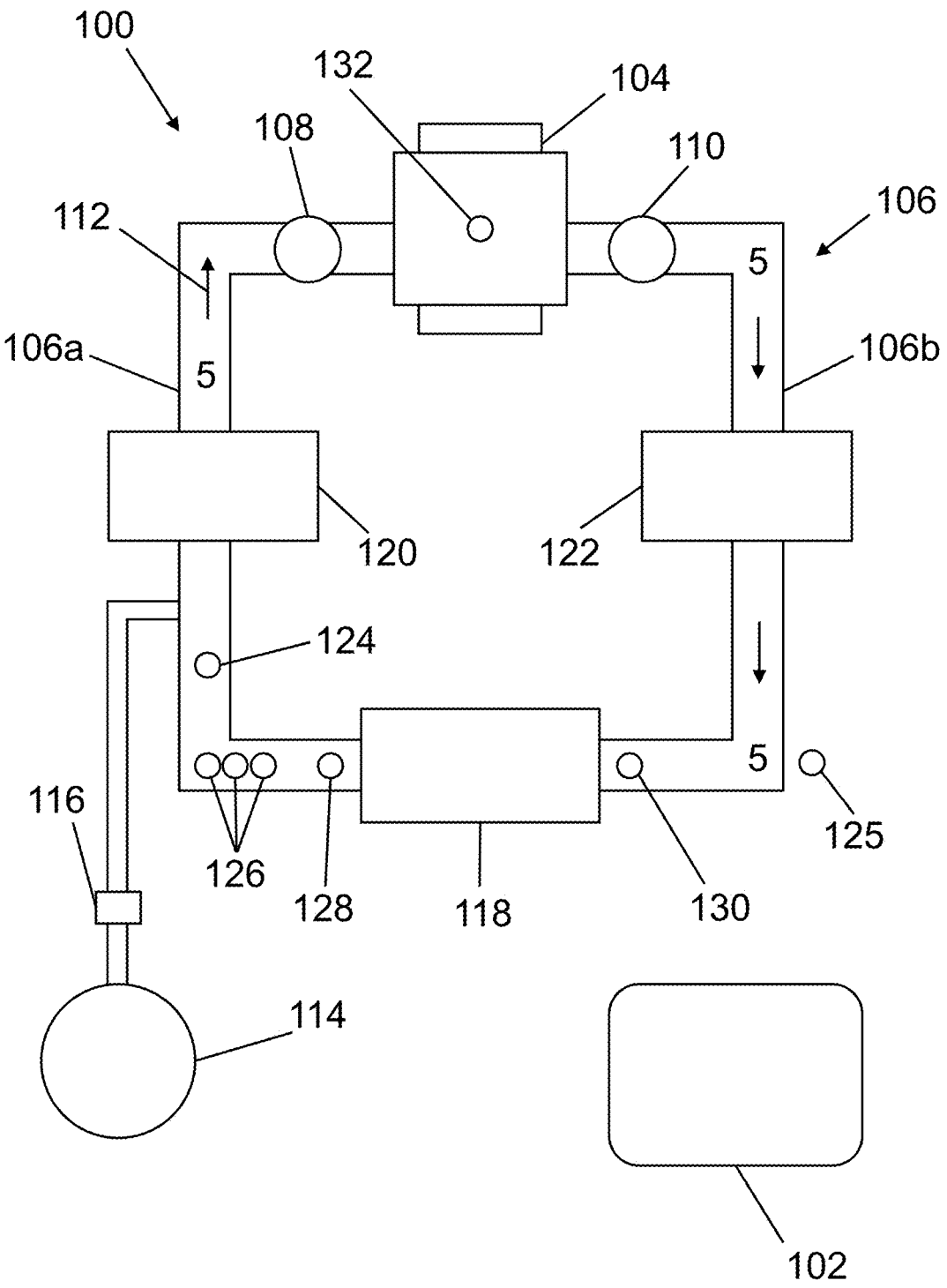
FIG. 1 is a schematic diagram of a breathing apparatus having a controller according to an embodiment of the invention.

FIG. 1 is a schematic diagram of a breathing apparatus having a controller 102 according to an embodiment of the invention. The breathing apparatus is a rebreather 100, which may typically be used for underwater diving. Of course, the rebreather 100 may have many more parts or components than those illustrated in FIG. 1, and the arrangement, shape, etc. of the rebreather 100 and its parts or components may be different to that illustrated in FIG. 1.

The rebreather 100 has a mouthpiece 104 through which a user of the rebreather can breathe a gas 5 in the rebreather. The rebreather 100 further comprises a breathing loop 106, having an upstream side 106*a* which is connected to the mouthpiece 104 via an upstream valve 108, and a downstream side 106*b* which is connected to the mouthpiece 104 via a downstream valve 110. The gas 5 is supplied to the mouthpiece 104 via the upstream side 106*a* of the breathing loop and the upstream valve 108. When the user exhales through the mouthpiece 104, the exhaled gas 5 is removed from the mouthpiece 104 via the downstream valve 110 and the downstream side 106*b* of the breathing loop. The upstream valve 108 and the downstream valve 110 are one-way valves, which are arranged to ensure that the gas 5 flows into the mouthpiece 104 from the upstream side 106*a* of the breathing loop when the user inhales, and that the gas 5 flows from the mouthpiece 104 into the downstream side 106*b* of the breathing loop 106 when the user exhales. In other words, the valves 108, 110 serve to ensure that the gas 5 flows around the breathing loop 106 in a single direction, as indicated by the arrows 112 in FIG. 1. Any suitable type of one-way valve may be used for the upstream and downstream valves 108, 110, such as mushroom valves.

A pressurised oxygen supply tank 114 is connected to the breathing loop 106 via a supply valve 116. When the user breathes the gas 5, oxygen in the gas 5 is used by the user and therefore removed from the gas 5. Accordingly, oxygen is injected (i.e. added) into the breathing loop 106 from the oxygen supply tank 114 via the supply valve 116, in order to replenish the oxygen used by the user. The supply valve 116 can be controlled by the controller 102, in order to control amount (volume) or rate of oxygen into injected into the rebreather 100. The supply valve 116 may be any suitable type of valve whose opening and closing can be electronically controlled, such as a solenoid valve. The controller 102 may be connected to the supply valve 116 via a wired connection (not shown), so that the controller 102 can transmit an electrical signal to the supply valve 116 in order to control a position of the supply valve 116. For example, the controller 102 may control whether the supply valve 116 is opened or closed, and in some cases an extent to which the supply valve is opened 116, in order to control the rate of injection of oxygen into the breathing loop 106. A pressurised air tank (not shown) may also be connected to the breathing loop, so that air (or diluent) can be injected into the breathing loop 106. The controller 102 may be configured to control injection of air into breathing loop 106 in a similar manner to how injection of oxygen is controlled. In this manner, a desired gas mixture may be maintained within the breathing loop 106.

The rebreather 100 further comprises a carbon dioxide absorbent unit 118 (or "scrubber"), which is a sealed canister containing a carbon dioxide absorbent material. A typical material used in such applications is soda lime, however other materials may also be used. The carbon dioxide absorbent unit 118 is connected to the breathing loop 106 such that gas exhaled by the user passes through the carbon dioxide absorbent unit 118 before it is recirculated to the mouthpiece 104. In this manner, the carbon dioxide absorbent unit 118 captures carbon dioxide exhaled by the user, to prevent a build-up of carbon dioxide inside the breathing loop 106.

The rebreather 100 may also comprise one or more counterlungs in the breathing loop 106. In the example shown, the rebreather 100 comprises an upstream counterlung 120 through which gas 5 on the upstream side 106*a* of the breathing loop passes before reaching the mouthpiece 104, and a downstream counterlung 122 on the downstream side 106*b* of the breathing loop through which exhaled gas passes. The volume of the counterlungs 120, 122 may vary in accordance with the user's tidal volume, to facilitate breathing with the rebreather 100.

The controller 102 may be in the form of a portable computing device, which has software installed thereon for performing the functions described herein. The controller 102 may comprise a memory in which data from sensors can be recorded. The controller 102 may also include a user interface (not shown), which enables a user to interact with the controller 102, e.g. in order to control various aspects of the rebreather 100. For example, the controller 102 may comprise one or more buttons and/or a touchscreen. The controller 102 may also be connected to a display (not shown), such as a screen or heads-up display, so that the controller 102 can notify the user of relevant information, such as status information for the rebreather 100.

The rebreather 100 further includes a series of sensors, which are used by the controller 102 in order to control the $PPO_2$ in the breathing loop 106, as well as to perform various calculations and monitor performance of the rebreather 100. The various sensors and their uses are discussed below.

Pressure Sensor

The rebreather 100 comprises a pressure sensor 124 in the breathing loop 106, and arranged to detect a pressure of the gas 5 in the breathing loop 106. In particular, the pressure sensor 124 is sensitive to variations (i.e. changes) of pressure of the gas 5 in the breathing loop 106. Any suitable type of pressure sensor may be used. For example, the pressure sensor 124 may be a differential pressure sensor that detects changes in pressure of the gas 5 relative to a reference pressure. In the example shown, the pressure sensor 124 is located in the upstream side 106*a* of the breathing loop. However, in other examples, the pressure sensor 124 may be arranged at a different location in the breathing loop 124. In some cases, there may be multiple pressure sensors arranged around the breathing loop 106, in order to detect the gas pressure at different locations in the breathing loop 106.

As the user of the rebreather 100 breathes, the pressure of the gas 5 in the breathing loop 106 will vary. Thus, the pressure in the breathing loop 106 will decrease when the user inhales, and will increase when the user exhales. Accordingly, the pressure sensor 124 can detect the variations in pressure inside the breathing loop 106 caused by the user's breathing. The pressure sensor 124 produces a first output signal that is indicative of the detected pressure variations, such that the first output signal can be used to monitor the user's breathing pattern.

The pressure sensor 124 is connected to the controller 102, e.g. via a wired or wireless connection (not shown), such that the controller 102 can receive the first output signal from the pressure sensor 124. The controller 102 is configured to determine, using the received first output signal, an oxygen consumption rate of the user. The determined oxygen consumption rate of the user may thus be determined substantially in real-time, based on detected pressure variations inside the breathing loop 106.

The rebreather 100 may further comprise an ambient pressure sensor 125, which is located outside the breathing loop 106, such that it is exposed to an ambient (e.g. water) pressure located outside the breathing loop 106. The ambient pressure sensor 125 is sensitive to the ambient pressure outside the breathing loop 106, and is configured to produce an output signal that is indicative of the ambient pressure. The ambient pressure sensor 125 is connected to the controller 102, e.g. via a wired or wireless connection (not shown), such that the controller 102 can receive the output signal from the pressure sensor 125. The controller 102 may then be configured to use the ambient pressure determined from the output signal from the ambient pressure sensor 125 as a reference for pressure variations in the breathing loop 106 detected with the pressure sensor 124. In other words, the controller 102 may measure pressure variations in the breathing loop 106 relative to the ambient pressure outside the breathing loop 106.

The first step for determining the user's oxygen consumption rate is to determine their breathing rate (e.g. in breaths per minute). The controller 102 does this by analysing the first output signal from the pressure sensor 124 (which may be referenced against the output signal from the ambient pressure sensor 125), to determine the breathing rate. The first output signal comprises a substantially periodic pattern of peaks (corresponding to pressure peaks in the breathing loop 106 caused by the user exhaling) and troughs (corresponding to pressure dips in the breathing loop 106 caused by the user inhaling). Thus, the controller 102 can determine a period of the first output signal, e.g. by determining a time interval between neighbouring peaks in the signal, and/or by determining the period of oscillations of the first output signal about its average. The period of the first output signal may correspond to a period between the user's breaths, such that the breathing rate can be determined.

Figure 2:
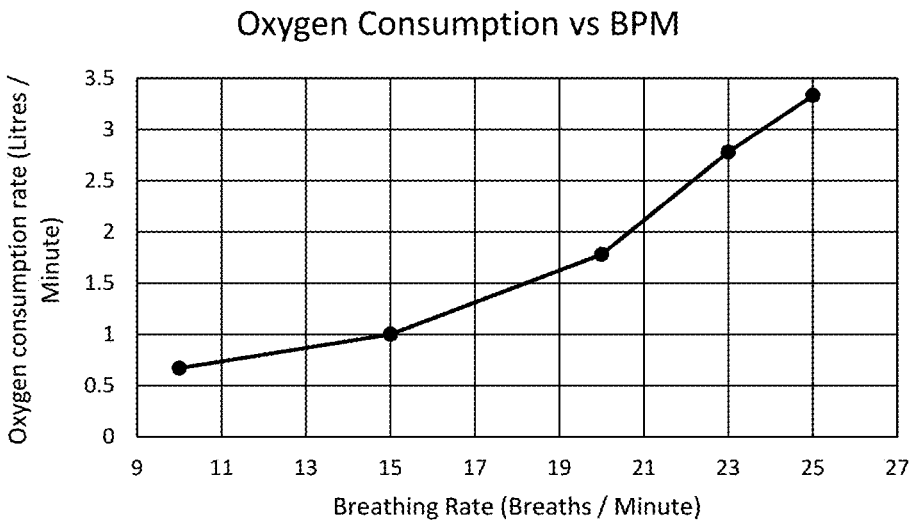
FIG. 2 is a graph showing a plot of a user's oxygen consumption rate as a function of their breathing rate.
Figure 3:
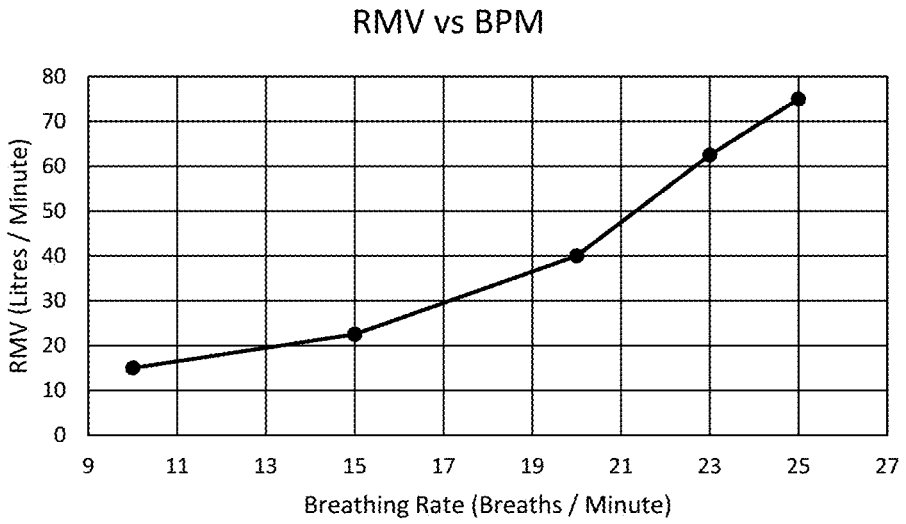
FIG. 3 is a graph showing a plot of the user's ventilation rate as a function of their breathing rate.
Figure 4:
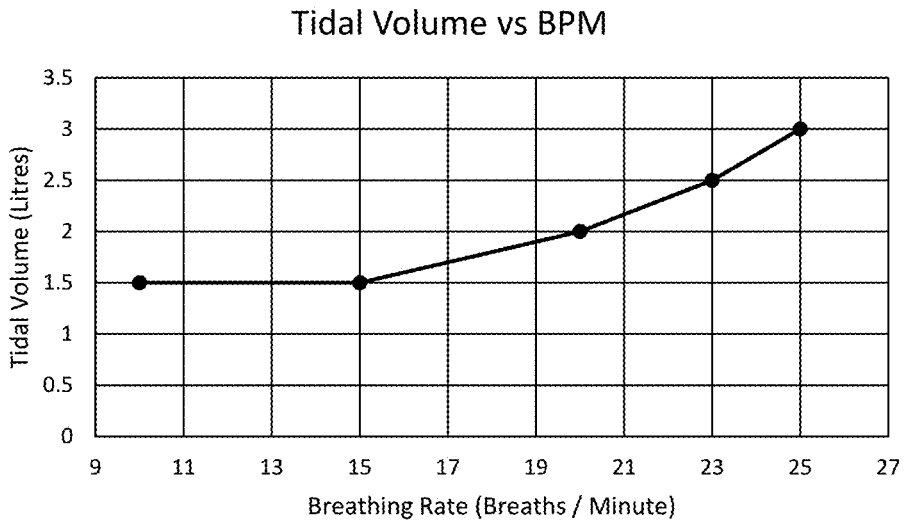
FIG. 4 is a graph showing a plot of the user's tidal volume as a function of their breathing rate.
Figure 5:
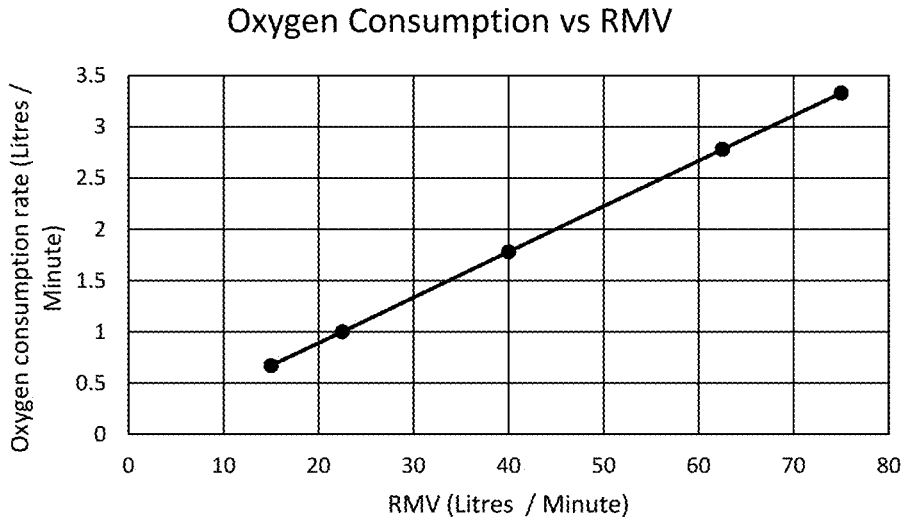
FIG. 5 is a graph showing a plot of the user's oxygen consumption rate as a function of their ventilation rate.

The controller 102 further stores data that enables it to determine the user's oxygen consumption rate from the breathing rate. FIGS. 2-5 show examples of data that may be used by the controller 102 for determining the user's oxygen consumption rate from their breathing rate. FIG. 2 is a graph showing the oxygen consumption rate (in litres per minute) for a user as a function of their breathing rate. FIG. 3 is a graph showing the respiratory minute volume (RMV), or ventilation rate, of the user as a function of their breathing rate. The RMV of the user is defined as:

$$RMV = T_V \times BR \tag{3}$$

where $T_v$ is the user's tidal volume, and BR is the user's breathing rate. FIG. 4 is a graph showing the user's tidal volume as a function of their breathing rate, whilst FIG. 5 is a graph showing the user's oxygen consumption rate as a function of their RMV. The data of FIGS. 2-5 is summarised in Table 1, below.

TABLE 1

| Breathing measurements | | | |
|---|---|---|---|
| Tidal Volume (Litres) | BPM (Breaths/ Minute) | RMV (Litres/ Minute) | Oxygen Consumption Rate (Litres/Min) |
| 1.5 | 10 | 15.0 | 0.67 |
| 1.5 | 15 | 22.5 | 1.00 |
| 2.0 | 20 | 40.0 | 1.78 |
| 2.5 | 23 | 62.5 | 2.78 |
| 3.0 | 25 | 75.0 | 3.33 |

The data shown in FIGS. 2-5 was measured experimentally for a user, using a breathing machine which records properties of the user's breathing.

As can be seen from FIG. 2, the user's oxygen consumption increases in a non-linear fashion as a function of their breathing rate. The data shown in FIG. 2 (or similar data) may be used by the controller 102 in order to determine the user's oxygen consumption rate based on their breathing rate. For instance, the controller 102 may store the data points shown in FIG. 2 and, following determination of the user's breathing rate, the controller 102 may perform an interpolation of the data points in order to determine a corresponding oxygen consumption rate. Alternatively, the controller 102 can determine the user's tidal volume based on their current breathing rate, using the data from FIG. 3. The user's tidal volume and breathing rate can then be used to calculate the user's RMV (e.g. using equation (3)). Then, using the data from FIG. 5, the controller 102 can determine the user's oxygen consumption rate. As shown in FIG. 5, the oxygen consumption rate is generally proportional to the RMV, although it should be noted that the proportional relationship may not hold when the user experiences carbon dioxide retention. Thus, using data such as that shown in FIGS. 2-5, it is possible to accurately estimate the user's current oxygen consumption rate based on the output signal from the pressure sensor 124. In particular, the data in FIGS.

2 and 5 takes enable changes in tidal volume as a function of breathing rate to be taken into account in the determination of the oxygen consumption rate.

The controller 102 may also be capable of estimating a user's tidal volume. For example, when the user is above the water surface (i.e. at atmospheric pressure), the controller 102 may estimate the user's tidal volume by referencing a pressure sensed in a known (fixed) volume of the counterlungs 120, 122 to a volume of gas. Additionally or alternatively, a typical value for the tidal volume may be input into the controller 102, and a breathing pattern of the user may be recorded, to establish a relationship between the tidal volume and breathing pattern. The controller 102 may then extrapolate values of the tidal volume for other breathing rates.

More generally, the controller 102 may store a relationship between the user's breathing rate and their oxygen consumption rate, so that it can determine the oxygen consumption rate from the determined breathing rate. For instance, the relationship may be a function that associates an oxygen consumption rate to a given breathing rate of the user. The relationship stored by the controller may be determined based on experimental data (such as that shown in FIGS. 2-5). For example, prior to using the rebreather 100, a user may perform various breathing measurements in order to determine a relationship between their breathing rate and their oxygen consumption rate, which may then be stored in the controller 102.

In some cases, the controller 102 may store multiple user profiles, each one being associated with a respective relationship between user breathing rated and oxygen consumption rate. Then, prior to using the rebreather 100, a user may select (e.g. via a user interface on the controller 102) one of the stored user profiles, so that the controller 102 uses the relationship associated with the selected profile when determining the oxygen consumption rate. Additionally or alternatively, the controller 102 may be configured to automatically generate a relationship between user breathing rate and oxygen consumption rate based on one or more user inputs (e.g. made via the controller's user interface). For example, a user may input information such their age, mass, height, fitness level, or any other relevant information, which the controller 102 then uses to generate the relationship (e.g. based on a set of rules that the controller is programmed with). This may enable the determination of the user's oxygen consumption rate to be tailored to their particular characteristics, which may improve an accuracy of the determination.

The controller 102 may be configured to store, in a memory of the controller 102, the determined oxygen consumption rate as a function of time. For example, the controller 102 may include a clock, such that determined values of the user's oxygen consumption rate can be time-stamped, thus enabling evolution of the user's oxygen consumption rate over time to be monitored.

In some embodiments, the determined oxygen consumption rate can be used in order to control the $PPO_2$ in the rebreather 100. In particular, the controller 102 may be configured to control an injection rate of oxygen into the breathing loop 106 from the oxygen supply tank 114, based on the user's oxygen consumption rate. The controller 102 may set the injection rate of oxygen into the breathing loop 106 to substantially match the user's oxygen consumption rate, by controlling the supply valve 116. In this manner, the oxygen injected into the breathing loop 106 may compensate for the oxygen consumed by the user, such that the $PPO_2$ in the breathing loop 106 may remain substantially constant.

The rate at which carbon dioxide is produced by a user's breathing is proportional to their oxygen consumption rate (i.e. to their oxygen metabolism). Accordingly, the user's carbon dioxide production rate can be directly determined from their oxygen consumption rated. Thus, in some embodiments, the controller 102 is configured to determine the user's carbon dioxide production rate based on the determined oxygen consumption rate. A known relationship between the oxygen consumption rate and carbon dioxide production rate may be stored in the controller 102, to enable the controller to determine the carbon dioxide production rate.

Knowing the carbon dioxide production rate of the user may be particularly useful, as it may enable the controller 102 to determine a remaining lifetime of the carbon dioxide absorbent unit 118, i.e. an amount of time left before the carbon dioxide absorbent unit 118 becomes saturated with carbon dioxide. Thus, the controller 102 may be configured to calculate the remaining lifetime of the carbon dioxide absorbent unit 118, based on a known carbon dioxide absorbance capacity of the carbon dioxide absorbent unit 118, and the user's carbon dioxide production rate. This may provide an accurate estimate of the remaining lifetime, as it is based on the user's metabolism. The controller 102 may then be configured to display the remaining lifetime of the carbon dioxide absorbent unit 118 on a display screen, so that the user may be aware of how much time is left. The controller 102 may also be configured to generate an alarm, if it determines that the carbon dioxide absorbent unit 118 is nearing the end of its lifetime, or that it has become saturated.

Typically, usage of the carbon dioxide absorbent unit 118 may depend on the partial pressure (or density) of carbon dioxide in the breathing loop 106 (e.g. a usage rate of the carbon dioxide absorbent unit 118 may increase with the partial pressure of carbon dioxide). As a result, usage of the carbon dioxide absorbent unit 118 may depend on one or more variables such as underwater depth, the gas mixture in the breathing apparatus, a work rate of the user, and a temperature of the gas in the breathing apparatus, as the partial pressure of carbon dioxide may be dependent on these variables. The breathing apparatus 100 may include sensors that are arranged to detect these variables. For instance, the breathing apparatus 100 may include a depth sensor for determining an underwater depth of the breathing apparatus, and/or a temperature sensor for determining a temperature of the gas in the breathing loop 106. Using outputs from these sensors, the controller 102 may determine a current usage rate of the carbon dioxide absorbent unit 118. For example, the controller 102 may store a lookup table which provides a relationship between usage rate of the carbon dioxide unit 118 and the outputs from the sensors (the lookup table may have been established experimentally beforehand). Then, from the current usage rate of the carbon dioxide unit 118, the controller 102 may estimate the remaining lifetime of the carbon dioxide unit 118. This estimate of the remaining lifetime may be used to cross-check and/or improve the estimate of the remaining lifetime which is obtained from the oxygen consumption rate.

In some embodiments, the controller 102 may be configured to monitor the first output signal from the pressure sensor 124, to determine whether there are any anomalies in the user's breathing patterns. During set-up of the rebreather 100, the rebreather 100 may be tested to determine a range of parameters for the first output signal from the pressure sensor 124 corresponding to a "normal" breathing pattern. In particular, a range of amplitudes of the first output signal that correspond to a "normal" breathing pattern may be determined, and stored in the controller 102. Then, during use of rebreather 100, if the amplitude of the first output signal is outside of "normal" range by more than a threshold amount, the controller 102 may determine that there is an anomaly in the user's breathing pattern and generate an alert. The alert may be displayed on a display screen, and/or provided in the form of an audible alert (e.g. via a speaker or earphone that is connected to the controller 102).

Where the controller 102 detects that the amplitude of the first output signal, and therefore an amplitude of the pressure variations in the breathing loop 106, is outside the "normal" range, the controller 102 may determine that one of the valves 108, 110 around the mouthpiece 104 has failed. For example, where the downstream valve 110 fails such that it is always open, this may result in much less of the breathing cycle being detected by the pressure sensor 124, which is located in the upstream side 106*a* of the breathing loop. As a result, the amplitude of the pressure variations detected by pressure sensor 124 will be reduced. So, when the controller 102 detects a reduction in the amplitude of the first output signal, it may determine that the downstream valve 110 has failed. Where the upstream valve 108 fails such that it is always open, the entire breathing cycle may occur in the upstream side 106*a* of the breathing loop 106. As a result, the amplitude of the pressure variations detected by the pressure sensor 124 will be increased. So, when the controller 102 detects in increase in the amplitude of the first output signal, it may determine that the upstream valve 108 has failed.

Of course, different criteria may be used for determining failure of one of the valves 108, 110, depending on the location of the pressure sensor 124 relative to the valves 108, 110. For example, in an embodiment where the pressure sensor 124 is instead located in the downstream side 106*b* of the breathing loop, the controller 102 may determine that the downstream valve 110 has failed if an increase in the amplitude of the first output signal is detected. It should also be noted that multiple pressure sensors may be placed at different locations in the breathing loop 106, to facilitate detection of a valve failure.

An anomalous breathing pattern may also be an indication that the user is at increased risk of carbon dioxide retention. Carbon dioxide retention is often associated with a heightened breathing rate. The controller 102 may store data that is indicative of a range of "normal" breathing rates during use of the rebreather 100. Then, during use of the rebreather 100, if the controller 102 determines that the user's breathing rate exceeds the range of "normal" breathing rates by more than a threshold amount, the controller 102 may determine that the user is at increased risk of carbon dioxide retentions, and generate a corresponding alert.

Oxygen Sensors

The rebreather 100 comprises a set of oxygen sensors 126 in the breathing loop 106. In the example shown, there are three oxygen sensors 126 located adjacent to one another, next to the carbon dioxide absorbent unit. However, in other examples, there may be more or fewer oxygen sensors, and the oxygen sensors may be arranged at different locations in the breathing loop 106. Each of the oxygen sensors is configured to detect the $PPO_2$ in the breathing loop 106, and to produce an output signal that is indicative of the $PPO_2$. Any suitable type of oxygen sensor may be used, such as an electro-galvanic sensor, a paramagnetic sensor, or a luminescent oxygen sensor.

The oxygen sensors 126 are connected to the controller 102, e.g. via a wired or wireless connection (not shown), such that the controller 102 can receive the output signals from the oxygen sensors 126. The controller 102 is then configured to determine the $PPO_2$ in the breathing loop 106 from the output signals from the oxygen sensors 126. For example, the controller 102 may use one or more calibration curves for determining the $PPO_2$ in the breathing loop 106 from the output signals. The purpose of providing multiple oxygen sensors 126 is to provide a level of redundancy, in case one or more of the oxygen sensors 126 fails. The controller 102 may determine the $PPO_2$ in the breathing loop 106 from the different output signals in any suitable manner. For instance, in some cases, the controller 102 may average the results obtained from the different output signals. The controller 102 may also apply the "voting logic" described in GB2525973B, for determining which oxygen sensor output signal (s) should be used for determining the $PPO_2$.

Thus, in addition to determining the user's oxygen consumption rate, the controller 102 can determine the current $PPO_2$ in the breathing loop 106. This may facilitate maintaining the $PPO_2$ in the breathing loop 106 at a desired level.

The controller 102 may be configured to use both the user's oxygen consumption rate, and the determined value of $PPO_2$, in order to control the $PPO_2$ in the breathing loop 106. Specifically, the controller 102 may be configured to control the $PPO_2$ in the breathing loop 106 based on the oxygen consumption rate when the current value of $PPO_2$ is within a narrow range around a set-point, and to otherwise control the $PPO_2$ in the breathing loop 106 based on the determined value of the $PPO_2$. This enables fine control of the amount of oxygen injected into the breathing loop 106 when the $PPO_2$ is close to the set-point, whilst avoiding the risk of the $PPO_2$ in the breathing loop 106 gradually drifting away from the set-point (which might occur if only the oxygen consumption rate were used for controlling $PPO_2$).

Thus, when the value of $PPO_2$ determined by the controller 102 using the output signals from the oxygen sensors 126 is within a predetermined range around a set-point value, control is performed using the determined oxygen consumption rate. This may be as discussed above, where the controller 102 controls the supply valve 116 such that the injection rate of oxygen into the breathing loop 106 compensates for the oxygen consumed by the user.

When the value of $PPO_2$ determined by the controller 102 using the output signals from the oxygen sensors 126 is outside the predetermined range around the set-point value, control is performed using the determined $PPO_2$ value. In this case, the controller 102 may control the supply valve 116 such that the injection rate of oxygen into the breathing loop 106 is proportional to a difference between the set-point and the determined $PPO_2$ value. In other words, the injection rate I may be set such that $I \propto (SP - PPO_2)$, where SP is the set-point value, and $PPO_2$ is the current value of $PPO_2$ in the breathing loop 106 determined using the output signals from the oxygen sensors. Of course, other methods for controlling the injection rate of oxygen based on the determined $PPO_2$ value may also be used.

The set-point is a target value for the $PPO_2$ in the rebreather 100. The controller 102 is configured to control the $PPO_2$ in the rebreather 100, so that it is maintained substantially at the set-point. The controller 102 can do this by controlling various aspects of the rebreather 100, such as the injection rate of oxygen into the breathing loop 106, and the venting of gas out of the breathing loop 106. The set-point may be stored in a memory of the controller 106. In some cases, the controller 102 may be configured to adjust the set-point for $PPO_2$ based on one or more factors, such as a current underwater depth, temperature of the gas 5 in the breathing loop 106, or any other relevant factors.

There may be factors which cause a change in oxygen usage in the rebreather 100, other than the user's metabolism, and which may be taken into account by the controller 102 when controlling $PPO_2$. For example, gas may be vented from the breathing loop 106 in case of over-pressure (e.g. via a pressure-release valve), or in some cases gases may manually be vented. In some cases, depth changes may result a change in the $PPO_2$ value, and may trigger automated gas addition or venting. Set-point changes (either manual or associated with depth changes) may also trigger automatic addition or venting of gas into the breathing loop 106. In some cases, the user may also be able to manually add oxygen and/or diluent into the breathing loop 106.

Where there is a failure with the oxygen sensors 126 (e.g. where the controller 102 is no longer able to obtain a reliable estimate of $PPO_2$ from the oxygen sensors 126), the controller 102 may be configured to control the $PPO_2$ in the breathing loop 106 using the determined oxygen consumption rate. This may ensure continued control of the $PPO_2$ in the breathing loop 106, even where no direct reading of the $PPO_2$ from the oxygen sensors 106 is available.

In a case where the oxygen sensors 126 have failed, the controller 102 may nevertheless estimate the current value of $PPO_2$ in the breathing loop 106, to ensure that the $PPO_2$ does not drift away from the set-point. This is achieved by calculating the current value of $PPO_2$ in the breathing loop 106 based on a previously determined value of the $PPO_2$, and the user's oxygen consumption rate. The previously determined value of the $PPO_2$ may correspond to a time $t_I$ when at least one of the oxygen sensors 126 was still working properly. The user's oxygen consumption since $t_I$ can be determined from their oxygen consumption rate, which enables the current value of $PPO_2$ to be estimated. As an example, the controller 102 can estimate the value of the $PPO_2$ at a current time t using the following equation:

$$PP\,O_2(t) = PP\,O_2(t_I) - \int_{t_I}^{t} C(t)dt + \int_{t_I}^{t} I(t)dt \tag{4}$$

where $PPO_2$ ($t_I$) is the previously determined value of the $PPO_2$ corresponding to time $t_I$, C(t) is the user's oxygen consumption rate as a function of time (as determined by the controller 102 based on the first output signal from the pressure sensor 124), and I(t) is the injection rate of oxygen into the breathing loop 106 as a function of time. The controller 102 may be configured to store the injection rate of oxygen as a function of time in its memory. Equation (4) may be modified to include additional terms, e.g. to take into account for any of the other ways in which oxygen may be added into, or removed from, the breathing loop 106.

As discussed above, the controller 102 controls the injection rate using the supply valve 116. Thus, to determine the injection rate as a function of time, the controller 102 can record the position of the supply valve 116 as a function of time, and use a corresponding calibration curve for converting the supply valve 116 position of injection rate. Additionally or alternatively, the injection rate of oxygen into the breathing loop 106 may be determined using a high-pressure sensor in the oxygen supply tank 114, as the high-pressure sensor can be used to determine the amount of oxygen supplied by the tank 114 over time.

Breathing Loop Carbon Dioxide Sensors

The rebreather 100 comprises a first carbon dioxide sensor 128 and a second carbon dioxide sensor 130 located in the breathing loop 106, on either side of the carbon dioxide absorbent unit 118. The carbon dioxide sensors 128, 130 are each configured to detect the $PPCO_2$ in the breathing loop 106, and to produce output signals that are indicative of the $PPCO_2$ at the sensors' respective locations in the breathing loop 106. Any suitable type of carbon dioxide sensor may be used, such as an optical or nondispersive infrared (NDIR) carbon dioxide sensor. It should be noted that, in other examples, there may be more or fewer carbon dioxide sensors, and these may be disposed at different locations in the breathing loop compared to the example shown in FIG. 1. The carbon dioxide sensors may in some cases be slow reacting (e.g. 90% full scale deflection in less than 1 minute), or fast reacting (e.g. with full scale deflection in less than 1 second). The full scale deflection (FSD) of a sensor corresponds to a maximum value that it can detect. Thus, the FSD of a carbon dioxide sensor may be a maximum value of its output signal, which corresponds to a maximum value of the $PPCO_2$ that it can detect.

The carbon dioxide sensors 128, 130 are connected to the controller 102, e.g. via a wired or wireless connection (not shown), such that the controller 102 can receive the output signals from the carbon dioxide sensors 128, 130. The controller 102 is then configured to determine the $PPCO_2$ at the sensor locations in the breathing loop 106 from the output signals from the carbon dioxide sensors 128, 130. For example, the controller 102 may use one or more calibration curves for determining the $PPCO_2$ from the output signals. The controller 102 may then display the determined values of $PPCO_2$ on a display screen, to notify the user of the current $PPCO_2$ in the breathing loop 106. The determined values of $PPCO_2$ may be monitored by the controller 102, such that various conditions can be detected.

The carbon dioxide sensors 128, 130 can be used to detect failure of one of the valves 108, 110 around the mouthpiece 104. In particular, if one or both of the valves 108, 110 fails such that it remains in an open state, not all carbon dioxide exhaled by the user may pass through the carbon dioxide absorbent unit 118. As a result, failure of one or both of the valves 108, 110 may result in a gradual increase of carbon dioxide within the breathing loop 106. Therefore, if the value of $PPCO_2$ determined from either of the carbon dioxide sensors 128, 130 exceeds a threshold value, the controller 102 may determine that one of the valves 108, 110 has failed. In such a case, the controller 102 may generate a corresponding alert.

The carbon dioxide sensors 128, 130 can also be used to detect a failure in relation to the carbon dioxide absorbent unit 118. For example, they may be used to detect saturation of the carbon dioxide absorbent unit 118, and/or that gas is bypassing the carbon dioxide absorbent unit 118. They may also be used to detect a failure in a sealing system of the carbon dioxide absorbent unit 118, or if the carbon dioxide unit 118 is not present. If the carbon dioxide absorbent unit 118 becomes saturated such that it no longer absorbs carbon dioxide, the $PPCO_2$ in the breathing loop 106 may increase. Similarly, if gas is somehow bypassing the carbon dioxide absorbent unit 118 (i.e. not all exhaled gas is passing through the carbon dioxide absorbent unit 118), if there is a failure in the sealing system of the carbon dioxide absorbent unit 118, or if the carbon dioxide absorbent unit 118 is missing, the $PPCO_2$ in the breathing loop 106 may increase. Thus, if the controller 102 detects that the $PPCO_2$ in the breathing loop 106 increases beyond a predetermined threshold, the controller 102 may determine that the carbon dioxide absorbent unit 118 is not absorbing carbon dioxide as expected. The controller 102 may then generate a corresponding alert.

In some cases, the controller 102 may determine that the carbon dioxide absorbent unit 118 is saturated by comparing the value of $PPCO_2$ determined from the first and second carbon dioxide sensors 128, 130. Indeed, as the first carbon dioxide sensor 128 is located on an inhale side of the carbon dioxide absorbent unit 118 and the second carbon dioxide sensor 130 is located on the exhale side of the carbon dioxide absorbent unit 118, the $PPCO_2$ value determined from the first carbon dioxide sensor 128 should be lower than the $PPCO_2$ value determined from the second carbon dioxide sensor 130 (if the carbon dioxide absorbent unit 118 is not saturated). However, if the carbon dioxide absorbent unit 118 is saturated, then the $PPCO_2$ values from both sensors may be substantially the same. So, if the controller 102 detects that the $PPCO_2$ values from both sensors are substantially the same, the controller 102 may determine that the carbon dioxide absorbent unit 118 is saturated.

$PPCO_2$ in the breathing loop 106 may also increase due to carbon dioxide retention by the user. Carbon dioxide retention may typically occur as a result of increased gas density, increased work of breathing, and/or increased exertion of the user. Accordingly, the controller 102 can determine that the user is at increased risk of carbon dioxide retention if the determined $PPCO_2$ increases beyond a threshold value.

Additional variables may also be taken into account for determining the risk of carbon dioxide retention. For example, the controller 102 can calculate a gas density of the gas 5 in the breathing loop 106. The rebreather 100 may comprise a pressure or depth sensor (not shown), for determining a current underwater depth of the user, which can be used for determining the density of the gas 5 in the breathing loop 106. The rebreather 100 may also comprise a temperature sensor (not shown), for detecting the temperature of the gas 5, which can be factored into the determination of the density of the gas 5. The controller 102 may be configured to determine a risk factor for carbon dioxide retention based on the determined gas density, e.g. by using a predetermined risk function which takes gas density as an input. The risk function may also take variables such as the user's ventilation rate, and the determined $PPCO_2$ values into account. Once the controller 102 has determined the risk factor for carbon dioxide retention, the controller 102 may display the determined risk factor on a display screen, in order to notify the user of the current risk factor. For example, a function for calculating the risk factor could be determined using experimental data (e.g. from clinical trials), from which a relationship between gas density (and other relevant factors) and carbon dioxide retention can be established.

Mouthpiece Carbon Dioxide Sensor

The rebreather 100 comprises a carbon dioxide sensor 132 located in the mouthpiece 104, for detecting carbon dioxide exhaled by the user. In particular, the carbon dioxide sensor 132 is configured to detect the $PPCO_2$ in gas exhaled by the user through the mouthpiece 104, and to produce an output signal indicative of the exhaled $PPCO_2$. The carbon dioxide sensor 132 could be similar to the carbon dioxide sensors 128, 130 mentioned above, e.g. the carbon dioxide sensor 132 could be a slow reacting sensor or a fast reacting sensor. If the carbon dioxide sensor 132 is to be used for breath by breath analysis (which may be used to determine carbon dioxide retention), then the carbon dioxide sensor 132 may preferably be a fast reacting sensor. In some embodiments (not shown), the mouthpiece 104 may include two carbon dioxide sensors, e.g. one located at an inlet side and one located at an outlet side of the mouthpiece 104. In such an embodiment, it may be possible to detect carbon dioxide retention even if the carbon dioxide sensors are both slow reacting sensors.

The carbon dioxide sensor 132 is connected to the controller 102, e.g. via a wired or wireless connection (not shown), such that the controller 102 can receive the output signal from the carbon dioxide sensor 132. The controller 102 is then configured to determine the $PPCO_2$ in the exhaled gas from the output signal from the carbon dioxide sensor 132. For example, the controller 102 may use one or more calibration curves for determining the $PPCO_2$ from the output signal.

The $PPCO_2$ in the user's exhaled can be used to determine their end-tidal carbon dioxide, which is the maximum expired carbon dioxide concentration during the breathing cycle. End-tidal carbon dioxide correlates well with arterial carbon dioxide, i.e. the concentration of carbon dioxide in arterial or venous blood. As a result, the $PPCO_2$ determined from the carbon dioxide sensor may provide a good indicator of an amount of carbon dioxide retained by the user, and so can be used to detect an onset of carbon dioxide retention. Thus, the controller 102 may be configured to, if the $PPCO_2$ determined from the carbon dioxide sensor 132 exceeds a predetermined threshold, determine that the user is experiencing carbon dioxide retention. The controller 102 may then generate a corresponding alert.

By comparing the value of $PPCO_2$ determined from the carbon dioxide sensor 132 with the values determined from carbon dioxide sensors 128, 130, the controller 102 can establish a relationship between exhaled carbon dioxide and the carbon dioxide detected in the breathing loop 106. In particular, this may enable the controller 102 to determine a response of the carbon dioxide sensors 128, 130, when carbon dioxide retention is detected with the carbon dioxide sensor 132. This may improve the controller's ability to detect carbon dioxide retention, and may also enable detection of carbon dioxide retention where the carbon dioxide sensor 132 is not functioning properly, or in rebreathers where the carbon dioxide sensor 132 has been omitted.

The value of $PPCO_2$ determined from the carbon dioxide sensor 132 may also provide a direct reading of the user's oxygen consumption rate, as the amount of oxygen consumed is proportional to the amount of exhaled carbon dioxide. Thus, the value of $PPCO_2$ determined from the carbon dioxide sensor 132 may be used to confirm the value of the user's oxygen consumption rate that was determined using the first output signal from the pressure sensor 124.

The value of $PPCO_2$ determined from the carbon dioxide sensor 132 may also be used to determine how much carbon dioxide is removed from the breathing loop 106 by the carbon dioxide absorbent unit 118. Accordingly, it may also be used to confirm the estimate of the remaining lifetime for the carbon dioxide absorbent unit 118 discussed above.

High-Pressure Sensor

The rebreather 100 may comprise a high-pressure sensor (not shown), which is arranged to detect a pressure of oxygen stored in the oxygen supply tank 114. The high-pressure sensor may be any suitable type of pressure sensor for detecting a gas pressure in a pressurised vessel. The high-pressure sensor is configured to produce an output signal that is indicative of the pressure of oxygen stored in the oxygen supply tank 114. The high-pressure sensor is connected to the controller, e.g. via a wired or wireless connection, such that the controller 102 can receive the output signal from the high-pressure sensor.

The pressure of the oxygen stored in the supply tank 114 is related to the amount of oxygen stored in the supply tank 114. Accordingly, the controller 102 can determine a remaining amount of oxygen left in the supply tank based on the signal received from the high-pressure sensor, e.g. using a suitable calibration curve. The controller 102 may be configured to record the amount of oxygen left in the supply tank 114 as a function of time, so that oxygen usage can be monitored. From this, the controller 102 can estimate the total amount of oxygen used by the user over a period of time, by comparing the current value of oxygen left in the supply tank 114 with the initial value of oxygen in the supply tank 114. Of course, the estimate may take into accounts events such as gas venting from the breathing loop 106.

The oxygen usage determined from the high-pressure sensor may be used by the controller 102 to confirm the oxygen consumption rate determined from the pressure sensor 124, e.g. by confirming that the user's oxygen consumption rate over time is consistent with the amount of oxygen used as determined from the high-pressure sensor. The oxygen usage determined from the high-pressure sensor may also be used to determine an average oxygen consumption rate by the user over a given period of time, which can also be used to confirm the results obtained from the pressure sensor 124.

The invention claimed is:

1. A controller for a breathing apparatus, the controller comprising:

a memory having computer-executable instructions stored therein; and a processor configured to execute the computer executable instructions, and being further configured to:

store a relationship between a breathing rate of a user of the breathing apparatus and oxygen consumption of the user;

receive a first output signal from a differential pressure sensor configured to detect variations in a total gas pressure of a gas mixture in the breathing apparatus, wherein the first output signal is indicative of the variations in the total gas pressure;

determine, using the first output signal, an oxygen consumption rate of the user of the breathing apparatus, wherein determining the oxygen consumption rate comprises:

determining a breathing rate of the user from the first output signal; and determining, based on the breathing rate, the oxygen consumption rate using the relationship between the breathing rate and oxygen consumption of the user; and control a partial pressure of oxygen in the breathing apparatus based on the determined oxygen consumption rate.

2. The controller according to claim 1, wherein the processor is further configured to:

receive a second output signal from an oxygen sensor, wherein the second output signal is indicative of a partial pressure of oxygen in the breathing apparatus; and determine a current value of the partial pressure of oxygen in the breathing apparatus, using the second output signal.

3. The controller according to claim 2, wherein the processor is further configured to:

if the current value of the partial pressure of oxygen is within a predetermined range around a set-point of the controller, control the partial pressure of oxygen in the breathing apparatus based on the determined oxygen consumption rate; and if the current value of the partial pressure of oxygen is outside the predetermined range around the set-point of the controller, control the partial pressure of oxygen in the breathing apparatus based on the current value of the partial pressure of oxygen.

4. The controller according to claim 2, wherein the processor is further configured to, in response to detecting a failure of the oxygen sensor, control the partial pressure of oxygen in the breathing apparatus based on the determined oxygen consumption rate.

5. The controller according to claim 2, wherein the processor is further configured to, in response to detecting a failure of the oxygen sensor, determine an estimate of the partial pressure of oxygen in the breathing apparatus using the determined oxygen consumption rate and a previously determined value of the partial pressure of oxygen.

6. The controller according to claim 1, wherein the processor is further configured to monitor a breathing pattern of the user using the first output signal from the differential pressure sensor, and, in response to detecting an anomaly in the breathing pattern, generate an alert.

7. The controller according to claim 6 wherein, in response to detecting the anomaly in the breathing pattern, the processor is further configured to determine that a valve in the breathing apparatus has failed, and/or that the user is at increased risk of carbon dioxide retention.

8. The controller according to claim 1, wherein the processor is further configured to:

receive a third output signal from a high pressure sensor of the breathing apparatus, wherein the third output signal is indicative of a pressure in an oxygen supply tank of the breathing apparatus;

determine an amount of oxygen consumed by the user based on the third output signal; and determine if the oxygen consumption rate obtained using the first output signal is consistent with the amount of oxygen consumed obtained using the third output signal.

9. The controller according to claim 1, wherein the processor is further configured to:

determine a carbon dioxide production rate of the user using the determined oxygen consumption rate; and determine a remaining lifetime of a carbon dioxide absorbent unit in the breathing apparatus based on the determined carbon dioxide production rate.

10. The controller according to claim 1, wherein the processor is further configured to:

receive a fourth output signal from a carbon dioxide sensor in the breathing apparatus, wherein the fourth output signal is indicative of a partial pressure of carbon dioxide in the breathing apparatus;

determine a current value of the partial pressure of carbon dioxide in the breathing apparatus, using the fourth output signal;

monitor the partial pressure of carbon dioxide in the breathing apparatus; and determine, based on the partial pressure of carbon dioxide, one or more of the following:

a failure with a valve in the breathing apparatus;

saturation and/or bypassing of a carbon dioxide absorbent unit in the breathing apparatus; and an increased risk of carbon dioxide retention by the user.

11. A breathing apparatus, comprising:

a differential pressure sensor configured to detect variations in total gas pressure of a gas mixture within the breathing apparatus and to produce a first output signal indicative of the variations in the total gas pressure within the breathing apparatus; and a controller according to claim 1.

12. A method of operating a breathing apparatus, the method comprising:

storing a relationship between a breathing rate of a user of the breathing apparatus and oxygen consumption of the user;

receiving a first output signal from a differential pressure sensor in the breathing apparatus, the differential pressure sensor being configured to detect variations in a total gas pressure of a gas mixture in the breathing apparatus, wherein the first output signal is indicative of variations in the total gas pressure;

determining, using the first output signal, an oxygen consumption rate of the user of the breathing apparatus, wherein determining the oxygen consumption rate comprises:

determining a breathing rate of the user from the first output signal; and determining, based on the breathing rate, the oxygen consumption rate using the relationship between the breathing rate and oxygen consumption of the user; and controlling a partial pressure of oxygen in the breathing apparatus, based on the determined oxygen consumption rate.

13. The method according to claim 12, further comprising:

receiving a second output signal from an oxygen sensor, wherein the second output signal is indicative of a partial pressure of oxygen in the breathing apparatus; and determining a current value of the partial pressure of oxygen in the breathing apparatus, using the second output signal.

14. The method according to claim 13, further comprising:

if the current value of the partial pressure of oxygen is within a predetermined range around a set-point of the controller, controlling the partial pressure of oxygen in the breathing apparatus based on the determined oxygen consumption rate; and if the current value of the partial pressure of oxygen is outside the predetermined range around the set-point of the controller, controlling the partial pressure of oxygen in the breathing apparatus based on the current value of the partial pressure of oxygen.

15. The method according to claim 13, further comprising, in response to detecting a failure of the oxygen sensor, controlling the partial pressure of oxygen in the breathing apparatus based on the determined oxygen consumption rate.

16. The method according to claim 12, further comprising:

receiving a third output signal from a high pressure sensor of the breathing apparatus, wherein the third output signal is indicative of a pressure in an oxygen supply tank of the breathing apparatus; and determining an amount of oxygen consumed by the user based on the third output signal.

17. The method according to claim 12, further comprising:

determining a carbon dioxide production rate of the user, using the determined oxygen consumption rate; and determining a remaining lifetime of a carbon dioxide absorbent unit in the breathing apparatus, based on the determined carbon dioxide production rate.

18. The method according to claim 12, further comprising:

receiving a fourth output signal from a carbon dioxide sensor in the breathing apparatus, wherein the fourth output signal is indicative of a partial pressure of carbon dioxide in the breathing apparatus; and determining a current value of the partial pressure of carbon dioxide in the breathing apparatus, using the fourth output signal.

19. A controller for a breathing apparatus, the controller comprising:

a memory having computer-executable instructions stored therein; and a processor configured to execute the computer executable instructions, and being further configured to:

store a relationship between a breathing rate of a user of the breathing apparatus and oxygen consumption of the user;

receive a first output signal from a differential pressure sensor configured to detect variations in a total gas pressure of a gas mixture in the breathing apparatus, wherein the first output signal is indicative of the variations in the total gas pressure;

determine, using the first output signal, an oxygen consumption rate of the user of the breathing apparatus, wherein determining the oxygen consumption rate comprises:

determining a breathing rate of the user from the first output signal; and determining, based on the breathing rate, the oxygen consumption rate using the relationship between the breathing rate and oxygen consumption of the user; and monitor a breathing pattern of the user using the first output signal from the differential pressure sensor, and, in response to detecting an anomaly in the breathing pattern, generate an alert.

* * * * *